US006416430B2

(12) United States Patent
Moore

(10) Patent No.: US 6,416,430 B2
(45) Date of Patent: Jul. 9, 2002

(54) WATER-SKIMMING SPORT BALL FOR USE IN COMPETITIVE WATER PLAY

(76) Inventor: Tom R. Moore, 7578 Broadview Farms La., Tallahassee, FL (US) 32308

( * ) Notice: Subject to any disclaimer, the term of this patent is extended or adjusted under 35 U.S.C. 154(b) by 0 days.

(21) Appl. No.: 09/816,090

(22) Filed: Mar. 26, 2001

Related U.S. Application Data

(63) Continuation-in-part of application No. 09/369,251, filed on Aug. 6, 1999, which is a continuation-in-part of application No. 09/272,173, filed on Mar. 18, 1999.

(60) Provisional application No. 60/082,292, filed on Apr. 20, 1998.

(51) Int. Cl.[7] ..... A63B 67/00

(52) U.S. Cl. ..... 473/466; 273/457

(58) Field of Search ..... 473/466, 465, 473/485, 415

(56) References Cited

U.S. PATENT DOCUMENTS 2,670,206 A * 2/1954 Brewster ..... 463/69
3,450,407 A * 6/1969 Russo ..... 473/438
5,499,822 A 3/1996 Sabourin
5,516,098 A 5/1996 Aiello
5,722,906 A 3/1998 Gentile

OTHER PUBLICATIONS

Trademark Registration No. 1,822,969, "Skidderball", Limners Studio, Registered: Feb. 22, 1994, Serial No.: 74/393,636, Filed: May 24, 1993.
Grandrabbits, www.grtoys.com/items/SM01001.asp—ad p. 1, 2 for G, Oct. 5, 2000.
Balls, www.playworks.net/Balls.html—p. 1–3, Oct. 5, 2000.
Gertie, product box front/rear panels, copyright 1996.
google search, website information, 6 pp. and Nov. 1, 1997 date for Gertie balls, 1 p., Oct. 5, 2000.

* cited by examiner

*Primary Examiner*—Paul T. Sewell
*Assistant Examiner*—M. Chambers
(74) *Attorney, Agent, or Firm*—Dowell & Dowell, P.C.

(57) ABSTRACT

A water-skimming ball for use in competitive water play wherein the ball is a specified composition and partially filled with fluids, not only to induce a skimming action of the ball across the surface of water for long distances when properly thrown relative to the surface of the water, but also to produce certain other desirable dynamics particularly suited to competitive water play.

5 Claims, 1 Drawing Sheet

WATER-SKIMMING SPORT BALL FOR USE IN COMPETITIVE WATER PLAY

CROSS REFERENCE TO RELATED APPLICATIONS

This application is a continuation-in-part of prior application Ser. No. 09/369,251 filed Aug. 6, 1999 which is a continuation-in-part application of Ser. No. 09/272,173 filed Mar. 18, 1999 which is related to provisional patent application of the U.S. Ser. No. 60/082,292 filed Apr. 20, 1998.

BACKGROUND OF THE INVENTION

1. Field of the Invention

The present invention relates to game apparatus. More specifically, the invention relates to a water-skimming ball for use in competitive water play wherein the ball is a specified composition and partially filled with fluids, not only to induce a skimming action of the ball across the surface of water for distances of up to and in excess of seventy-five (75') feet when properly thrown relative to the surface of the water, but also to produce certain other hereinafter-described desirable dynamics particularly suited to competitive water play.

2. Description of the Related Art

Generally as to all kinds of balls. Game balls, play balls and sports balls come in various sizes, weights, textures, compositions and the like. Historically, most balls are specifically designed for use on land or on hard surface play areas such as courts, alleys, table tops, and the like. In many sports, the development of the ball is an ongoing process with newer designs and better materials being brought together in novel combinations in order to obtain a desired effect or better performance when in use.

Innovations in game balls and play balls have been known which enable the balls to act in a predetermined manner. Internal bladders, covers and valves in balls such as footballs, basketballs, soccer balls and tennis balls have continuously been modified to achieve better play characteristics, increased player control, more predictable response during course of play and to achieve more economical and reliable balls.

It also has been known in the art to modify the motion characteristics of balls by utilizing interior weighting devices or materials to affect a ball's performance. For instance, it is known to place weights, particles, liquids and other materials within the interior of balls to vary their motion characteristics when projected along a hard surface.

By way of example, in U.S. Pat. No. 5,516,098 to Aiello, a sport ball for roller or street hockey is disclosed wherein the ball, approximately 2.6 inches (6.6 cm) in diameter, is designed to take the place of a hockey puck for use on a hard surface. The ball is designed to contain approximately 10% to 25% liquid, such as water, to inhibit the ball from bouncing when hit with a hockey stick during play. Thereafter, in U.S. Pat. No. 5,722,906 to Gentile, a sport ball for playing street hockey is disclosed wherein the liquid used to create the hockey puck is antifreeze instead of water.

Generally as to balls used in water play. With few exceptions, almost all known balls have been designed for use in land-based games such as the ball described in the aforementioned patent to Aiello. There have been relatively few balls developed which are particularly designed or adapted for use in an aquatic environment such as in a swimming pool, in a lake or along the sea shore.

Many people are familiar with conventional beach balls that are frequently used in an aquatic environment but are generally used in play or thrown while on land. There have been games developed for water play which are based upon games played on land, such as water polo and water basketball. These games utilize hollow balls having essentially the same characteristics as their equivalent land based balls. But, there is no particular cooperation required between the balls and the water other than the fact that the balls should float. Other than some skipping of the balls used in those games, the throwing of such balls in those games is more often than not accompanied by the splat of the ball hitting upon and stopping in the water after being thrown through the air. The balls do not easily move across or on the surface of the water upon contact with the water and are not classified as water-skimming balls, as hereinafter discussed.

U.S. Pat. No. 5,499,822 to Sabourin, discloses a soccer type game to be played in a swimming pool. That patent discloses use of a ball completely filled with water so as to have a density sufficient for the ball to remain on the bottom of a swimming pool during game play.

The only known prior art as to a ball that skims the surface of water with little to no bounce consists of the following two water-skimming play balls: a) an unpatented but commercially marketed and trademarked product called a Skidderball™ and b) the water-skimming play ball of the provisional patent application and regular patent application which preceded this continuation-in-part.

The Skidderball™ and the play ball of the provisional and regular applications that preceded this continuation-in-part properly each may be classified, as will be shown below, as a play ball as opposed to a game ball or sport ball designed for use in competitive water play.

The Skidderball™ is self-described as an "action water ball" with the meaning being that it can be made to skid or skim across the surface of water. It is described by its manufacturer as 9" in diameter and is to be infused with water as instructed by the manufacturer. It may be made to skid, slide or skim across the water for distances up to about 15 feet. But, it will not skid more than about 15' no matter how much force is applied in propelling it. The same is true of the play ball discovered by the inventor's son and as disclosed in the aforementioned applications, which ball has a diameter of 8⅝" and contains a similar mix of water and air to that of the Skidderball™. Each play ball is light in comparison with the ball of the present invention, with the point being that both are in the same category of being too light to be propelled very far. The overstated analogy would be that one cannot throw a feather very far in part simply because of how light it is.

Both the Skidderball™ and the play ball properly are called action water balls or water-skimming balls, but the degree of their action in the water is limited as described. As shown in more detail herein, both are suited for casual water play rather than competitive water play for additional reasons than just their inability to skim very far.

Even when thrown with considerable force, not only is there a serious limit on their water-skimming movement, but also there is a notable absence of any other kind of unexpected, novel or eye-catching dynamics of a water-skimming play ball. That is so whether the play ball is propelled across the surface of open water or is thrown at an angle against a wall of a swimming pool.

In water play with such a play ball there is no visible suggestion or evident disclosure of any particular dynamics that would serve to encourage refinement of the art, specifically as to how a different water-skimming ball might act in open water or upon being propelled against a wall of a swimming pool. Simply stated, with hindsight it now can be said that this likely is because of the relative lightness of the play ball and lack of force generally applied in propelling it what short distance it is able to travel in skimming the water.

Because of its limitations, a water skimming play ball is not suitable for serving as the centerpiece for any fast-paced competitive game or sport played in the water. Such a play ball not only cannot travel very far on the surface of the water, but also because it is too light in weight, cannot be propelled very far in the air either, relative to typical balls used in playing water polo and water basketball. Further, such a play ball gives no hint of the discoveries that were yet to be made by the inventor of the ball of the present invention, which have become a part of and incorporated into the refinement of the art to produce a water-skimming sport ball specifically for use in competitive water play, with novel and unique dynamics that go beyond being able to skim much greater distances.

Even though water inhibits quick human movement from one location to another in the water, as noted there nevertheless are team water sports that are played in the water, with a ball as the main piece of game equipment. As noted, water polo is one of those games, which is an Olympic sport. Another is water basketball.

These team water sports utilize the provided ball, as expected, by having the participants throw the ball within an area of play and into goals. But, there is nothing special about such balls or in how they behave in competitive water play.

While the ball often is intentionally skipped across the water in water polo, the provided ball does not have any ability to skim the water. Further, there most certainly is not a rule in water polo to preclude lobbing the ball over the head of an opponent. Indeed, this is done over and over and over.

In games or a sport designed to take full advantage of the water-skimming ability of the ball of the present invention, however, it is almost fundamental that the ball must be skimmed across the water surface. In fact, it is the novel dynamics of the sport ball of the present invention that makes games and a sport played with the sport ball in themselves novel and unique.

No water polo game has ever been played with a water-skimming ball that can do and does what the ball of the present invention can do and does in competitive play. If the ball of the present invention were to be suggested for use, and used, as the principal piece of game apparatus for playing water polo, then the strategies of the game would change dramatically. Water polo would no longer be the same game.

For example, players would gravitate more toward the side walls to receive passes from team mates. This would take advantage of the novel wall-hugging characteristic that the sport ball of the present invention optimizes by design. Players also would learn that it is better to skim the ball than to lob it, because their developable skills include skimming the ball precisely to the spot where they want to place it. This is the result of the novel and unique ducking motion of the sport ball of the present invention at the end of every run or skimming of the ball across the water.

The inventor enhanced that dynamic by design.

More significantly, new and novel games using the sport ball of the present invention most certainly will take advantage of the unique and novel characteristics of the sport ball. For example, consider again the dynamic of how the sport ball hugs the side wall of a pool when thrown against the wall at an angle of 45 degrees or less. In the related Continuation-In-Part Application U.S. Ser. No. 09/369,251 filed Aug. 6, 1999, the sport therein described uniquely provides for four corner goals. This facilitates the use of the walls in zipping a shot past a goalie and into an opponent's goal. This is just as significant as how that dynamic enables a player to more easily place the ball in the hands of a team mate who positions himself or herself near a side wall.

The unique ability of the sport ball of the present invention to skim the surface of water for long distances, in addition to its other dynamic and novel characteristics, cry out for the development of new and unique water games that focus on the significance of such characteristics. New games, with new rules, can utilize these unique characteristics and dynamics of the ball of the present invention. That is why the inventor has a companion application regarding a new sport played with the sport ball of the present invention. The most fundamental rule of that new sport, which uses the sport ball of the present invention as its principle piece of game apparatus, is that the ball cannot be thrown with any upward trajectory. It must be skimmed with a throw that is parallel to or downward relative to the surface of the water.

SUMMARY OF THE INVENTION

The present invention is directed to a ball specifically structured for competitive use in an aquatic environment.

The inventor set out to refine the prior art related to a water-skimming play ball, not knowing where that might lead or what such effort might produce. The inventor set out to produce a sport ball that not only can skim the surface of water a significant distance, but also can satisfy other objectives for a ball suitable for highly competitive play in or on the water.

The result of that effort is the ball of the present invention.

This sport ball or game ball for competitive water play, is not a play ball for casual play. For starters, the ball of the present invention is structured and designed to zip across the water more than seventy-five (75') feet when properly thrown.

It also is structured and designed to optimally advance certain novel characteristics discovered in the course of developing its ability to skim long distances. These novel characteristics, discussed below, are enhanced by the ball's particular combination of diameter, mass and balance of fluids, all in anticipation of use of the ball in competitive play. As will be seen, the resulting dynamics achieved by the ball of the present invention show that it is likely to become the centerpiece or principal piece of game apparatus for playing new and unique water sports that use such a water-skimming ball.

Because of the particular relative amounts of the liquids (preferably water and air) to the mass and diameter of the ball of the present invention, the ball possesses the unique combination of features that produce the following discovered and enhanced dynamics that are highly desirable in the playing of competitive games in the water.

These dynamics are:

(1) first, as discussed, the impressive distance (in excess of 75') that the sport ball will skim the water surface when thrown with sufficient force to drive it that far across the water surface;

(2) second, the enhanced ducking movement that the sport ball will make at the end of each run or throw across the water surface, which facilitates the development of player skills in throwing and placing the sport ball at precisely the spot or distance that the thrower wishes during competitive play; and (3) third, wall-hugging characteristic that the sport ball evidences when skimmed with force against the wall of a swimming pool at an angle of approximately 45% or less to the wall.

In the Skidderball™ and other such play balls, the first of these dynamics is impossible to achieve. In fact, one cannot skim a Skidderball™ even a third of the distance that may be achieved with a ball of the present invention.

As to the other two featured dynamics of the ball of the present invention, their existence is imperceptible in a Skidderball™, even when one looks for such dynamics and knows what he or she is trying to observe. The inventor discovered the latter two dynamics only after experimenting with and successfully designing a ball that achieved a skimming ability for a much greater distance than that of the prior art. Then, once perceived, those dynamic characteristics also were fostered and enhanced.

Additionally and not incidentally, the sport ball of the present invention by intentional design also is structured to accomplish other objectives related to its desirability for use as a competitive game ball. These are:

(1) the sport ball comfortably fits in the human hand, which facilitates each player's abilities both to catch it with one hand and to throw it with either hand;

(2) the total weight of the ball (about 410 grams) allows the above-stated dynamics to be optimally achieved without being so heavy as to tire a player too easily from his or her throwing of the ball over and over in competitive play.

This continuation-in-part constitutes a disclosure of how to build the sport ball of the present invention, which zips across the surface of water for distances from 10 feet to distances exceeding seventy-five (75') feet, which additionally acts in the above-mentioned new, exciting and unexpected ways in competitive water play and, lastly, also meets players' preferences for a ball that feels good and has a proper total weight.

The preferred embodiment of the ball of the present invention is a sport ball that is approximately 6½" in diameter when inflated, made of an impervious material weighing approximately 110 grams in its uninflated shell form, that is inflated or infused with a combination of fluids, preferably air and water. When water and air are used, the volume of water by weight that is infused into the ball is approximately 300 grams (or 300 cubic centimeters), for a total weight of approximately 410 grams when the balance of the cavity of the ball is filled with air.

The ball of the present invention does not embrace any balls of less than six inches in diameter or more than approximately seven and one-half inches in diameter. As the diameter becomes smaller, the ball becomes more and more like a missile than a game ball, and increasingly becomes more difficult to skim for the shorter distances of its range.

The ball of the present invention constitutes the "game apparatus" that enables its users to speed-up the playing of competitive water games with a water-skimming ball created specifically for competitive water play, particularly for team water sports.

BRIEF DESCRIPTION OF THE DRAWING

A better understanding of the invention will be had with reference to the drawing.

DESCRIPTION OF THE PREFERRED EMBODIMENT

Figure 1:
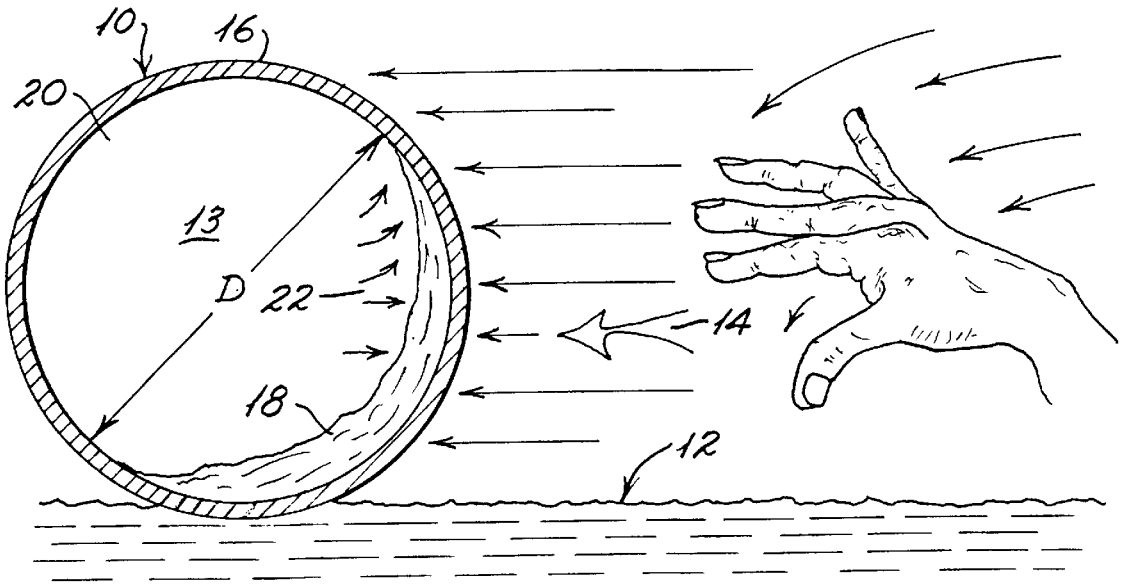
FIG. 1 shows a ball of the present invention in cross section and an indication of the required trajectory of the ball to establish a skimming or sliding motion of the ball as it is propelled by an individual across a surface of water.

With particular reference to FIG. 1, a ball 10 of the present invention will be described in detail. The ball is shown in FIG. 1 as it has been propelled by an individual throwing the ball such that it moves generally across the surface 12 of a body of water in a skimming or sliding motion. As will be discussed below, the proper propelling motion is important to develop the skimming motion of the ball relative to the water surface.

The ball is generally spherical in configuration having an interior volume or cavity 13 which is filled with two fluids having different specific gravities. One fluid is a gas and the other a liquid. The gas is preferably air and fills a major portion of the cavity 13 as indicated by the number 20. The liquid 18 is preferably a free flowing liquid, such as water, which is not restrained within the cavity 13. It is contemplated that other liquids, semi-liquids and flowable gels can also be used. As the ball skims across the surface, the liquid therein will move rearwardly, as is shown in the cross section of FIG. 1, with the motion of the liquid being indicated by the arrows 22.

The ball is preferably formed of a natural or synthetic rubber or plastic material having resilient side walls 16. The ball is preferably formed having a diameter "D" which is approximately 6.25 inches to 7.25 inches for competitive play. The ball may be grasped and propelled with either hand.

Although not shown in the drawing, an appropriate valve may be provided for introducing the fluids, such as air and water, into the interior cavity 13. The valve may or may not be one that facilitates re-inflating the ball. In some embodiments, the ball may be manufactured and supplied to users with the fluids sealed within the cavity 13. The side walls are thus formed so as to be fluid impervious. Other than as naturally occurs through osmosis, the internal pressure and internal weight of the contents remain as consistent as possible throughout the life of the ball.

The pressure of the fluid such as gas within the cavity may vary depending upon the overall size and weight characteristics of the particular embodiment of the ball. It is important, however, that the walls of the ball be pliable such that an individual may grasp the ball but such that the walls thereof are not easily deformed without exerting a conscious amount of finger pressure.

For each embodiment of the invention, the amount of free flowing fluids required to achieve the optimum or near-optimum skimming effect varies as to the percentages of the total inside volume for each particular embodiment. The physical characteristics of the ball include variable parameters such as size, weight, mass, volume and texture. However, it is preferred that the ball be of such size that is manageable in human hands, of a weight that is not too heavy to throw easily and not too light to preclude it from traveling some enjoyable distance, of a mass that compliments its skimming ability for the size and weight chosen, of a volume that also compliments the parameters of size, weight and mass, and of a texture and hardness/softness that enables an individual to easily grasp it without such texture and hardness/softness detracting from the ability of the ball to skim the water when properly propelled.

The amount and combination of fluids, such as liquid and gas, may also vary in order to optimize the skimming or sliding capability of the ball when propelled relative to the surface of the water. In the preferred embodiments, sufficient liquid, such as water, is provided within the cavity of the ball to provide weight to maximize the skimming ability of the ball and such that the ball does not have a tendency to skip relative to the water surface when propelled at a low angle of incidence relative to the surface of the water, i.e. an angle approaching a generally parallel relationship with respect to the surface of the water as shown by the arrow 14 in FIG. 1.

One of the unique effects developed by the ball of the present invention is the reaction of the ball to impact with a side wall of a swimming pool. In this respect, when the ball 10 is propelled at an angle of approximately 45 degrees or less with respect to a side wall, the ball will tend to track or follow the side wall as it moves following impact. One would normally expect that a ball engaging a side wall would tend to bounce at an angle outwardly relative to the side wall and back within the area of the pool, like a billiard ball off the side wall of a billiards table. However, because of the dynamics of the liquid in the ball, the ball does not bounce from the side wall. The motion of the liquid will change direction upon impact such that the liquid tends to move forward and toward the side wall thus propelling the ball along the side wall. This unexpected motion may be and is utilized by players as a tactical procedure in a competitive game using the ball of the present invention.

If too much liquid is utilized within the cavity of the ball of the present invention, the ball will have a tendency to sit down or sink causing increased friction or drag relative to the surface of the water which will reduce the skimming or sliding effect of the ball. Further, if too little liquid is utilized within the ball, the ball will also lose its optimum skimming or sliding effect and will tend to skip relative to the surface of the water or to stop movement. There must be a sufficient mass to create a driving force inwardly of the ball to produce the necessary skimming effect. Thus there must be sufficient liquid within the cavity to provide enough mass to retain the ball in contact with the water surface, but not so much as to create increased drag of the ball across the surface of the water.

The preferred embodiment of the ball of the present invention is a game ball 6.5 inches (16.5 cm) in diameter formed of a water impervious plasticol weighing approximately 3.875 ounces (110 grams). The ball is filled with air and water to a weight of approximately 14.125 ounces (410 grams), such that the amount of water included within the cavity is approximately 10.25 ounces (300 grams). The water volume of this ball occupies approximately 14% of the volume of the interior cavity. When properly propelled, this ball successfully achieves the designed objective of traversing the entire width of a 75' wide Olympic size swimming pool (or length of a so-called Junior Olympic size pool).

Another embodiment is a game ball constructed from a rubber material having an outer diameter of approximately 7.5 inches (19 cm) and a wall thickness of 0.4 inches. The ball when filled with approximately 29 ounces (820 grams) of water, constituting approximately 23% of the inside volume of the ball, will skim long distances quite effectively. This embodiment, however, takes considerable force to propel it the longer distances. Because it is heavier, it also tends to tire the user more quickly than the preferred embodiment.

There are a number of different embodiments of the present invention within the ranges of the parameters indicated herein, each of which may achieve a water-skimming effect when properly propelled. Any ball in excess of 7.5 inches is not embraced here. Such size becomes less desirable in terms of a player's ability to grasp it and throw it with one hand, and it becomes rather heavy and tiring to use. Similarly, any ball less than 6.25 inches in diameter is not embraced here, for reasons indicated earlier.

As previously discussed, in order to obtain the maximum skimming effect in propelling balls of the present invention, the balls should be thrown at a low angle of incidence relative to the surface of the water. Such angles should be as close as possible to parallel with the surface of the water so that the balls will slide or skim along the surface with little to no bounce. Skipping of a ball may be accomplished by increasing the angle of incidence and propelling the ball with enough force to cause it to bounce off the surface. As observed, this is a useful technique for avoiding an opponent who is trying to block a pass or shot on goal.

The foregoing description of preferred embodiments have been presented to illustrate the principles of the invention and not to limit the invention to the particular embodiments illustrated. It is intended that the scope of the invention be defined by all embodiments encompassed within the following claims and their equivalents.

What is claimed is:

1. A sport ball for use in competitive water play wherein the ball skims across the surface of the water with little tendency to bounce relative to the water surface, the ball comprising: a hollow sphere of fluid impervious material being between 6.25 inches and 7.5 inches in diameter and defining an interior cavity, first and second fluids provided within said cavity and being freely moveable therein, a first of said fluids being a gas and a second of said fluids being a freely flowing liquid, each of said fluids having a different specific gravity, and said fluids being present in an amount by ratio such that the ball, when propelled at a low angle of incidence relative to a surface of water, will skim the surface for distances up to and in excess of seventy-five feet, and will tend to hug or travel along a wall of a swimming pool if propelled against such wall at an angle of 45% or less to the wall, the weight of the ball without the first and second fluids is approximately 3.875 ounces (110 grams) and when a free flowing liquid is added of approximately 10.25 ounces (300 grams), the total weight after inflation of the remainder of the cavity with the gas is approximately 14.25 ounces (410 grams), and the diameter of the ball being between approximately 6.25 inches and approximately 6.75 inches.

2. The ball of claim 1 wherein the gas is air and the freely flowing liquid is water.

3. The ball of claim 1 wherein the diameter is 6.5 inches.

4. A sport ball for use in competitive water play wherein the ball skims across the surface of the water with little tendency to bounce relative to the water surface, the ball comprising: a hollow sphere of fluid impervious material being between 6.25 inches and 7.5 inches in diameter and defining an interior cavity, first and second fluids provided within said cavity and being freely moveable therein, a first of said fluids being a gas and a second of said fluids being a freely flowing liquid, each of said fluids having a different specific gravity, and said fluids being present in an amount by ratio such that the ball, when propelled at a low angle of incidence relative to a surface of water, will skim the surface for distances up to and in excess of seventy-five feet, and will tend to hug or travel along a wall of a swimming pool if propelled against such wall at an angle of 45% or less to the wall, and the ball has a diameter of approximately 7.5 inches, a wall thickness of approximately 0.40 inch and when a free flowing liquid is added to the cavity of approximately 29 ounces, the free flowing liquid constitutes approximately 23% of a volume defined by said cavity.

5. The ball of claim 4 wherein the gas is air and the freely flowing liquid is water.

* * * * *